US008413912B2

(12) United States Patent
Songbe

(10) Patent No.: US 8,413,912 B2
(45) Date of Patent: Apr. 9, 2013

(54) PUSH-BUTTON FOR A PRESSURIZED PRODUCT DISPENSING SYSTEM

(75) Inventor: Jean-Pierre Songbe, Eu (FR)

(73) Assignee: Rexam Dispensing Systems S.A.S. (FR)

( * ) Notice: Subject to any disclaimer, the term of this patent is extended or adjusted under 35 U.S.C. 154(b) by 279 days.

(21) Appl. No.: 12/879,327

(22) Filed: Sep. 10, 2010

(65) Prior Publication Data

US 2011/0057057 A1 Mar. 10, 2011

(30) Foreign Application Priority Data

Sep. 10, 2009 (FR) ..... 09 04371

(51) Int. Cl.
*B05B 7/32* (2006.01)

(52) U.S. Cl. ..... 239/337; 239/463

(58) Field of Classification Search ..... 239/472, 239/461, 463, 468, 469, 475, 482, 337
See application file for complete search history.

(56) References Cited

U.S. PATENT DOCUMENTS

| | | | | |
|---|---|---|---|---|
| 5,110,052 | A * | 5/1992 | Graf et al. | 239/333 |
| 5,127,579 | A * | 7/1992 | Tempelman | 239/337 |
| 5,147,087 | A * | 9/1992 | Fuchs | 239/333 |
| 6,338,442 | B1 * | 1/2002 | De Laforcade | 239/337 |

FOREIGN PATENT DOCUMENTS

| | | | |
|---|---|---|---|
| EP | 0796661 | A1 | 9/1997 |
| EP | 1688668 | A2 | 8/2006 |
| EP | 1837082 | A1 | 9/2007 |
| FR | 2772644 | A1 | 6/1999 |
| FR | 2887232 | A1 | 12/2006 |
| FR | 2907106 | A1 | 4/2008 |
| GB | 1550200 | A | 8/1979 |

OTHER PUBLICATIONS

French Search Report; Application No. FR 0904371; Apr. 9, 2010; 8 pages.

* cited by examiner

*Primary Examiner* — Davis Hwu
(74) *Attorney, Agent, or Firm* — St. Onge Steward Johnston & Reens LLC

(57) ABSTRACT

A push-button for a pressurized product dispensing system, including a body having a mounting shaft on a pressurized product supply tube and a housing equipped with a passage for dispensing the product between the shaft and a swirl assembly including a swirl chamber provided with a dispensing aperture as well as at least one supply channel for the chamber, in which the push-button also includes a needle movably mounted in the housing between a position closing the supply of the dispensing aperture and a position opening the supply; the needle has an actuation bearing in communication with the dispensing passage so as to enable the movement of the needle into the opening position; the needle has a distal wall arranged opposite the dispensing aperture so as to form the base of the swirl chamber when the needle is in the opening position, and the distal wall has a recess.

14 Claims, 3 Drawing Sheets

PUSH-BUTTON FOR A PRESSURIZED PRODUCT DISPENSING SYSTEM

CROSS-REFERENCE TO RELATED APPLICATIONS

The present application claims priority of French patent application No. 09 04371 filed on Sep. 10, 2009, the content of which is incorporated herein by reference.

FIELD OF THE INVENTION

This invention relates to a push-button for a system for dispensing a pressurized product, as well as such a dispensing system.

BACKGROUND OF THE INVENTION

In a specific application, the dispensing system is intended to provide bottles used in perfumery, cosmetics or for pharmaceutical treatments. Indeed, this type of bottle contains a product that is delivered by a dispensing system including a device for pressurized discharge of said product, in which said system is actuated by a push-button to enable the product to be sprayed. In particular, the discharge device includes a pump or a valve with manual actuation by means of the push-button.

Such push-buttons classically include a body having a shaft for mounting on a tube for supplying the pressurized product and a housing in communication with said shaft. The housing is equipped with a passage for dispensing the product between the shaft and a swirl assembly including a swirl chamber provided with a dispensing aperture as well as at least one supply channel for said chamber. In particular, the swirl chamber is arranged so as to rotate the product very quickly so that it is discharged through the aperture with enough speed to be fractionated into small droplets in suspension in the air so as to form an aerosol.

In order for the remaining product contained in the push-button not to dry out between two uses and to remain preserved from degradations due to its contact with the air, it is known to equip the push-buttons with devices for reversibly closing the dispensing aperture.

In particular, the push-button can include a needle that is movably mounted in the housing between a position closing the supply of the dispensing aperture and a position opening said supply. The needle has an actuation bearing in communication with the dispensing passage so as to enable the movement of said needle into the opening position by pressurization of the product in said passage.

The needles used according to the prior art are generally equipped with a tip closing the dispensing aperture from the inside of the swirl chamber, in which said tip is conical so as to enable it to be self-centered and consequently ensure the tightness of the closure.

However, the use of such needles involves the disadvantage of producing an aerosol of poor quality and difficult to reproduce from one use to another because the vortex formed in the swirl chamber is unstable since it is based on a tip, and sometimes through it if the tip is off-centered. In addition, as it is used, the tip tends to clog the opening of the dispensing aperture, and partially plugs the passage for the product in the aperture and degrades the quality of the aerosol.

SUMMARY OF THE INVENTION

The invention is intended to solve the problems of the prior art by proposing, in particular, a push-button equipped with a needle for reversibly closing the dispensing aperture, in which the quality of the aerosol generated by the swirl assembly can be guaranteed.

To this end, and according to a first aspect, the invention proposes a push-button for a pressurized product dispensing system, in which said push-button includes a body having a shaft for mounting on a pressurized product supply tube and a housing in communication with said shaft, said housing is equipped with a product dispensing passage between said shaft and a swirl assembly including a swirl chamber equipped with a dispensing aperture as well as at least one supply channel for said chamber, said push-button also includes a needle that is movably mounted in the housing between a position of closing the supply of the dispensing aperture and a position of opening said supply, said needle has an actuation bearing in communication with the dispensing passage so as to enable the movement of said needle to the opening position by pressurization of the product in said passage, said needle has a distal wall arranged opposite the dispensing aperture so as to form the base of the swirl chamber when said needle is in the opening position, and said distal wall has a recess.

According to a second aspect, the invention proposes a system for dispensing a pressurized product, including a discharge device equipped with a tube for supplying the pressurized product on which the shaft of such a push-button is mounted so as to enable the product to be sprayed.

BRIEF DESCRIPTION OF THE DRAWINGS

Other features and advantages of the invention will appear in the following description, in reference to the appended figures, in which.

DETAILED DESCRIPTION OF THE INVENTION

Figure 1:
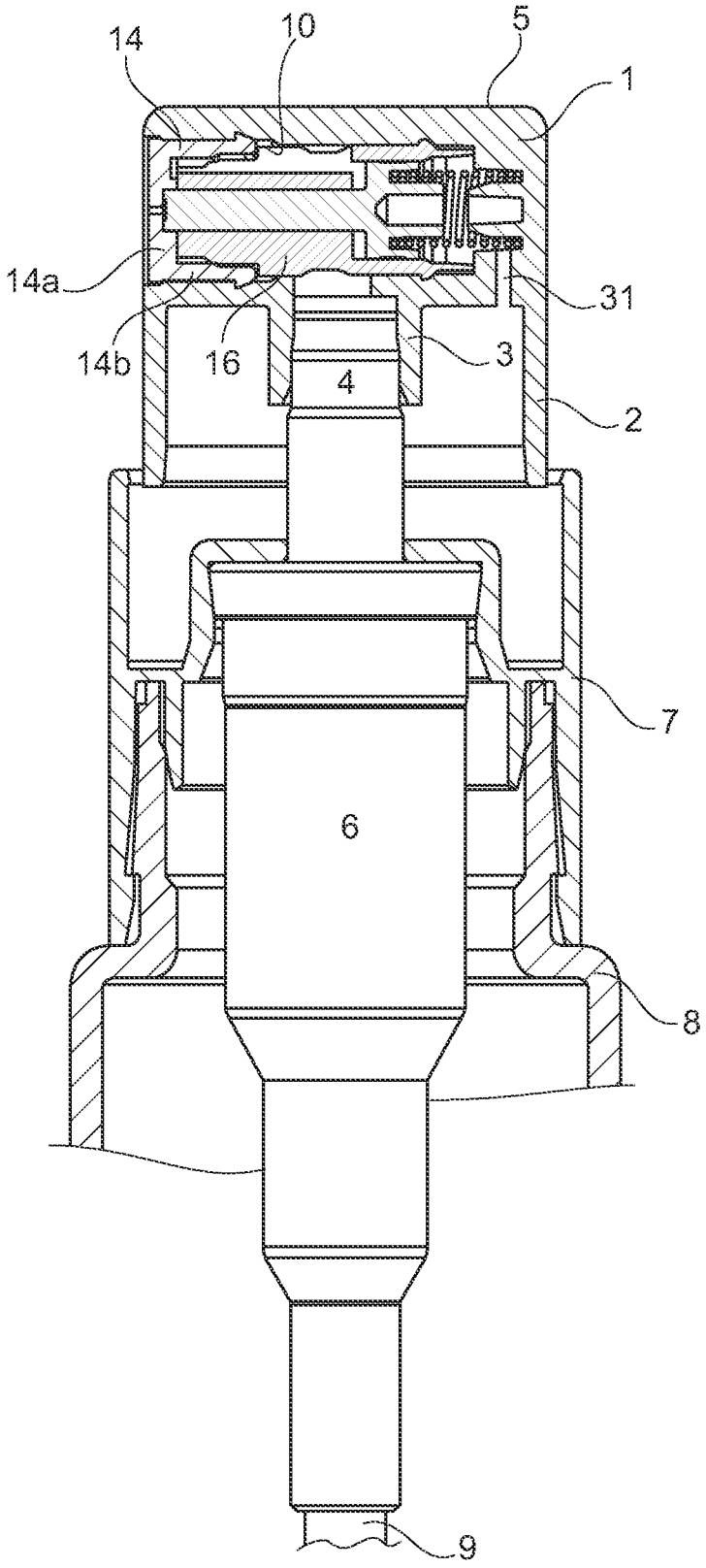
FIG. 1 is a partial longitudinal cross-section view of a dispensing system according to an embodiment of the invention, which is mounted on a bottle, in which the needle is in the dispensing aperture closure position.

In reference to the figures, a push-button for a system for dispensing a product, in particular pressurized liquid, will be described below, in which said product can be of any type, in particular used in perfumery, cosmetics or for pharmaceutical treatments.

The push-button includes a body 1 having an annular skirt 2 that surrounds a shaft 3 for mounting the push-button on a tube 4 for supplying the pressurized product. In addition, the push-button includes an upper area 5 enabling the user to exert finger pressure on said push-button in order to move it axially.

In reference to FIG. 1, the dispensing system includes a discharge device 6 equipped with a tube 4 for supplying the pressurized product, which is inserted tightly into the shaft 3. In a known manner, the dispensing system also includes means 7 for mounting on a bottle 8 containing the product and means 9 for discharging the product into said bottle, which are arranged so as to supply the supply tube 4 with pressurized product.

The discharge device 6 can include a manual actuation pump or, if the product is packaged under pressure in the bottle, a manual actuation valve. Thus, when the push-button is manually moved, the pump or the valve is actuated so as to supply the supply tube 4 with pressurized product.

The body 1 also has an annular housing 10, which is in communication with the shaft 3. In the embodiment shown, the housing 10 has an axis perpendicular to that of the mounting shaft 3 so as to enable lateral spraying of the product with respect to the body 1 of the push-button. In an alternative not shown, the housing 10 can be co-linear to the shaft 3, in particular for a push-button forming a spray end piece.

The housing 10 is equipped with a pressurized product dispensing passage between the shaft 3 and a swirl assembly including a swirl chamber 11 equipped with a dispensing aperture 12 as well as at least one supply channel 13 for said chamber.

In an embodiment shown, the push-button includes a spray nozzle 14 arranged in the recess 10, in which said nozzle has a front radial wall 14*a* on the inside of which a hollow cavity for the supply channels 13 as well as the swirl chamber 11 equipped with the dispensing aperture 12 are formed. In an alternative not shown, a cavity for the swirl assembly can be formed directly on a wall of the housing 10, in particular for a spray end piece.

Advantageously, the nozzle 14 and the body 1 are produced by molding, in particular a different thermoplastic material. In addition, the material forming the nozzle 14 has a rigidity that is greater than the rigidity of the material forming the body 1. Thus, the high stiffness of the nozzle 14 enables the deformation thereof to be avoided when it is mounted in the housing 10. In addition, the lower stiffness of the body 1 enables a better feel during actuation and improved tightness between the mounting shaft 3 and the supply tube 4.

In an example embodiment, the body is made of polyolefin and the nozzle 14 is made of cyclic olefin copolymer (COC), poly (oxymethylene) or poly (butylene terephthalate).

The nozzle 14 has a rotary cylindrical side wall 14*b* that is closed at the front by the wall 14*a*. The housing 10 has a rear wall 10*a*, an interior wall 10*b* and a front opening 10*c* in which the outer face of the lateral wall 14*b* is fitted, and the rear edge of said outer face is also equipped with a radial projection 15 for anchoring the nozzle 14 in said housing.

Figure 4:
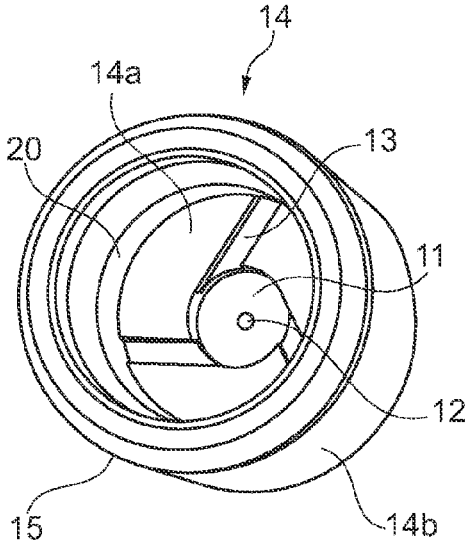
FIGS. 4 to 6 are perspective views, respectively, of the nozzle, the barrel and the needle of the push-button shown in FIGS. 1 to 3.

In reference to FIG. 4, the swirl assembly cavity includes three radial supply channels 13 that lead laterally into the swirl chamber 11, in which said channels have a constant U cross-section. In addition, the swirl chamber 11 has a rotary cylindrical shape, and the dispensing aperture 12 is formed at the center thereof. However, a different number of supply channels 13 can be provided, optionally with a modified orientation and/or shape, as well as another mode for supplying the swirl chamber 11. In particular, the dispensing aperture 12 can be off-centered with respect to the swirl chamber 11 so as to compensate for any hydrodynamic imbalance, for example if there is only one channel 13.

Figure 5:
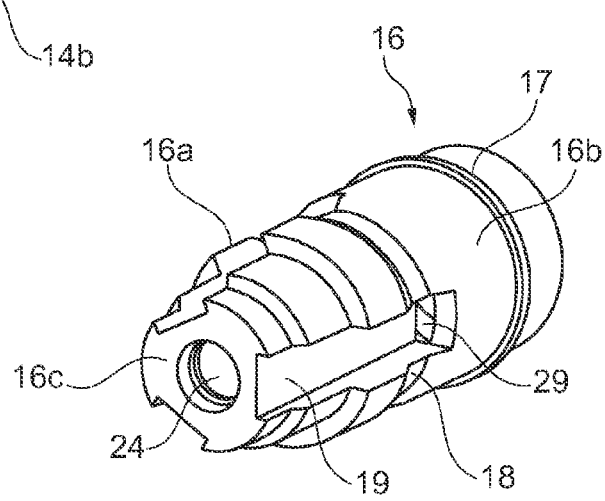

The push-button also includes a barrel 16, which is secured to the housing 10. In reference to FIG. 5, the barrel 16 has a front portion 16*a* and a rear portion 16*b* of which the internal diameter is greater than the external diameter of said front portion, and said barrel is attached in the housing 10 by fitting the outer face of said rear portion on the interior wall 10*b* of said housing. In addition, the outer face is equipped with a radial projection 17 for anchoring the barrel 16 in the housing 10, and the rear portion 16*b* abuts the rear wall 10*a* of said housing.

The product dispensing passage between the shaft 3 and the swirl assembly is formed between the periphery of the barrel 16 and the inside of the housing 10. More specifically, in the embodiment shown, the dispensing passage is formed between the periphery of the front portion 16*a* and the internal wall 10*b* of the housing 10.

To do this, the interior wall 10*b* has a rotary cylindrical shape and the periphery of the front wall 16*a* has a hollow cavity that is formed so that the dispensing passage includes:

- an upstream annular conduit 18 into which the product leaving the shaft 3 leads;
- at least one axial channel 19 communicating on either side, respectively, with said upstream annular conduit and with a downstream annular conduit 20 with which the supply channels 13 of the swirl chamber 11 communicate.

In the embodiment shown, three axial channels 19 are equally distributed on the periphery of the front portion 16*a*; however, a different number of channels 19, in particular different from the number of supply channels 13, can be provided.

In addition, the barrel 16 has a planar distal wall 16*c* that extends radially so as to be in contact with the supply channels 13 of the swirl chamber 11 in order to define the base thereof. More specifically, the distal wall 16*c* is in contact with the inside of the front wall 14*a* of the nozzle 14 so as to close, from the rear, the cavity for the supply channels 13, and said front wall of the nozzle 14 also has a cavity for the downstream annular conduit 20 with which the cavity for the supply channels 13 communicates.

The push-button also includes a needle 21, which is movably mounted in the housing 10 between a position of closing the supply of the dispensing aperture 12 and a position of opening said supply. To enable the reversible closure between two uses of the dispensing aperture 12, the needle 21 has a bearing 22 in communication with the dispensing passage in order to actuate the movement of said needle into the opening position by applying pressure on the product in the dispensing passage. In addition, the push-button includes means 23 for resilient return of the needle 21 to the closure position.

Thus, the needle 21 at rest is in the closure position and, by supplying the product in the dispensing passage, which is closed, the pressure exerted by said product on the actuation bearing 22 is sufficient to overcome the force of the return means 23 in order to move said needle into the opening position. At the end of the dispensing, the reduction in pressure in the dispensing passage causes the needle 21 to move to the closure position under the effect of the return means 23.

Figure 2:
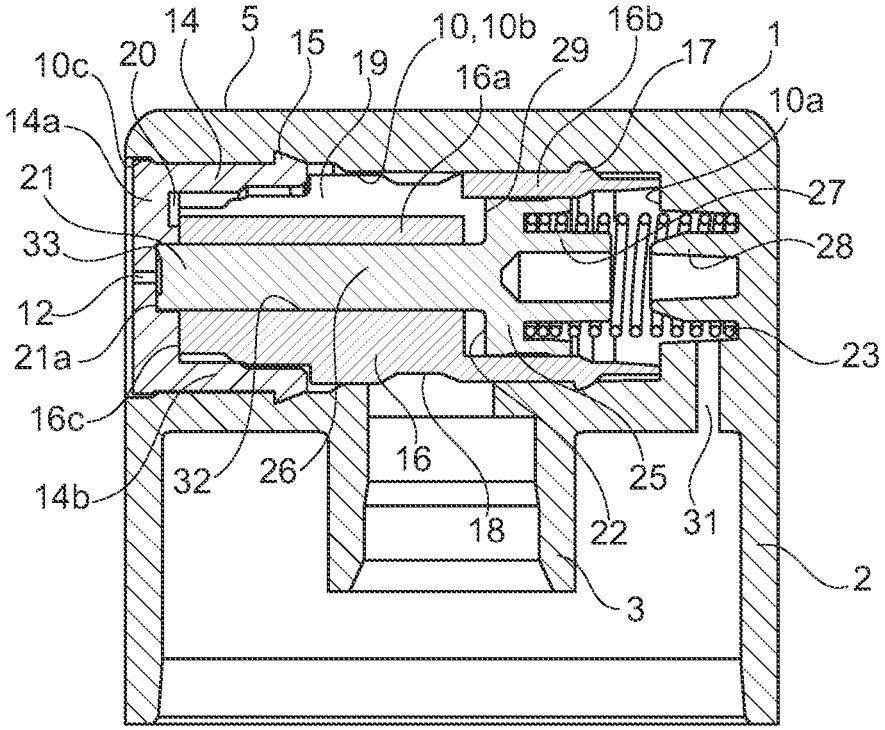
FIG. 2 is a longitudinal cross-section view of the push-button shown in FIG. 1.
Figure 3:
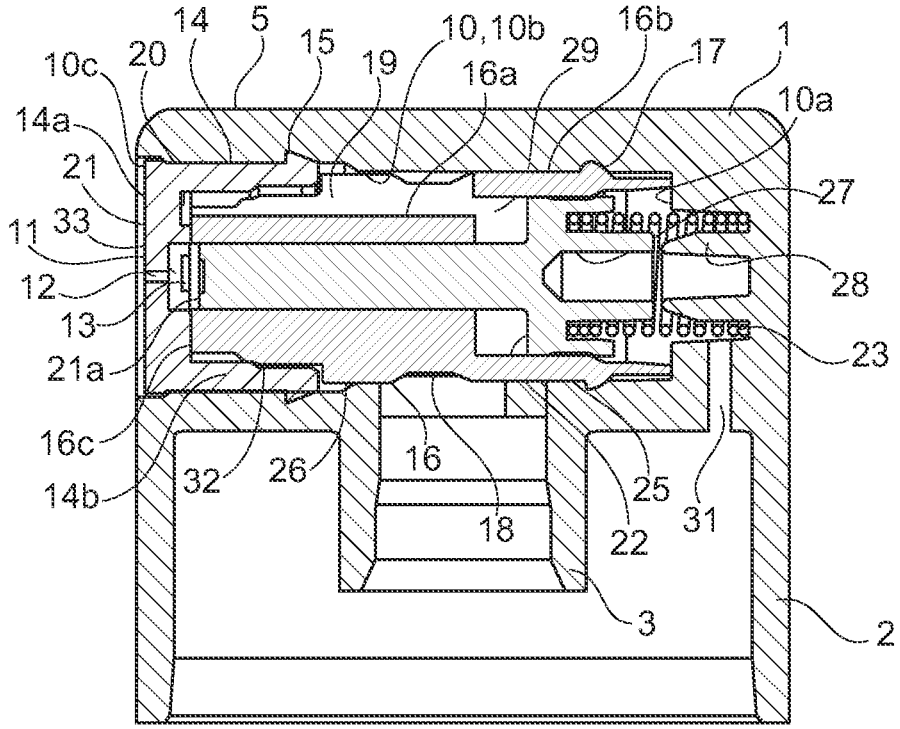
FIG. 3 is a longitudinal cross-section view of the push-button of FIG. 2, in which the needle is in the dispensing aperture opening position.

In addition, the needle 21 has a distal wall 21*a* arranged opposite the dispensing aperture 12 to form the base of the swirl chamber 11, when said needle is in the open position. In the embodiment shown, the needle 21 is mounted in translation with respect to the dispensing aperture 12 between the closure position in which the distal wall 21*a* is pressed tightly, in particular by being pushed by the return means 23, against said aperture so as to close off the supply thereof (FIG. 2) and the opening position in which said distal wall is removed from said aperture to form the base of the swirl chamber 11 (FIG. 3).

Figure 6:
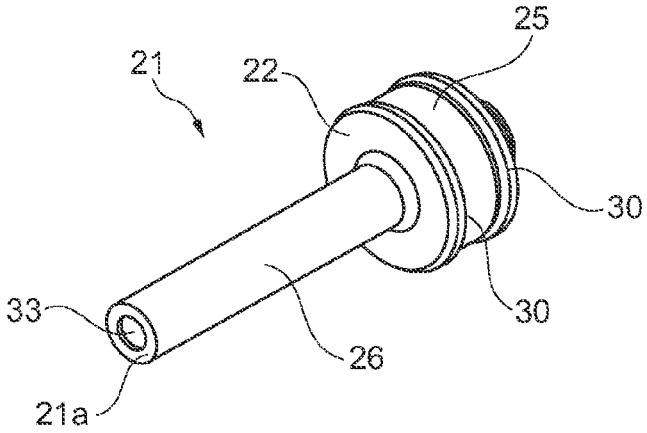

The barrel 16 has a bore 24 in which the needle 21 is movably mounted, and said bore passes through the front 16*a* and rear 16*b* portions. In reference to FIG. 6, the needle 21 includes a base 25 that is housed in the rear portion 16*b* of the barrel 16 and a rod 26 that is housed in the front portion 16*a* of said barrel, and the actuation bearing 22 is formed radially on the front face of said base so as to be housed in said rear portion.

The resilient return means are formed by a spring 23, which is inserted between the rear of the base 25 and the rear wall 10*a* of the housing. To do this, a pin 27, 28 is formed respectively on the base 25 and on the rear wall 10*a*, and each end of the spring 23 is mounted around one of said pins in order to stabilize the axial compression and decompression, respectively, thereof as the needle 21 is arranged, respectively, in the opening and closing position.

To place the actuation bearing 22 in communication with the dispensing passage, the bore 24 of the rear portion 16*b* communicates with said passage by means of at least one passage 29 formed in the barrel 16. In reference to FIG. 5, a passage 29 is formed on the rear end of each axial channel 19.

The actuation bearing 22 is mounted so as to slide tightly into the bore 24 of the rear portion 16*b*. To do this, the periphery of the base 25 is equipped with two axially spaced sealing beads 30, in which said beads are in tight sliding contact with the interior of the bore 24.

In addition, the front of the actuation bearing 22 is in communication with the dispensing passage so that the rear of the dispensing passage is defined by said actuation wall. In addition, the rear of the actuation bearing 22 is in communication with a venting conduit 31 that is formed in the body 1 of the push-button, so as to prevent the compression of air during movements of the needle 21 with respect to the housing 10.

Thus, when the product is supplied under pressure in the dispensing passage, it fills the upstream annular conduit 18 and passes through the passages 29 so as to soak the front of the actuation bearing 22. As the product cannot be ejected through the dispensing aperture 12, which is closed by the distal wall 21*a*, the pressure rises and is exerted on the actuation bearing 22, which, being mobile, retracts to open the supply of said aperture as it forms the swirl chamber 11. The pressurized product then rotates in the swirl chamber 11, is pushed toward the center of said chamber and is ejected through the dispensing aperture 12 to form the aerosol.

In the embodiment shown, the distal wall 21*a* is formed radially on the distal end of the rod 26, and said end is mounted so as to slide tightly into the bore 24, ensuring the positioning of said distal portion with respect to the dispensing aperture 12. To do this, the bore 24 can include a sealing bead 32 on which the periphery of the distal end of the rod 26 slides.

In the closure position of the needle 21, the distal end of the rod 26 is arranged in the cavity of the swirl chamber 11 so as to close off the dispensing aperture 12, in particular at the supply of said swirl chamber by the channels 13. In the embodiment shown, the external diameter of the distal end of the rod 26 is substantially equal to the internal diameter of the cavity of the swirl chamber 11.

In the opening position, the swirl chamber 11 is defined axially between the cavity and the distal wall 21*a*, with the distal wall 16*c* of the barrel 16 laterally closing said chamber by tight contact on the rear of the front wall 14*a* of the nozzle 14, in particular at the cavity of the supply channels 13.

The distal wall 21*a* of the needle 21 has a recess 33 that enables the vortex formed in the swirl chamber 11 to be stabilized, and therefore that enables the control as well as the reproducibility of the aerosol to be ensured. In addition, the recess 33 makes it possible to prevent the base of the swirl chamber 11 from becoming convex, due, for example, to production dispersions or deformations of the distal wall 21*a* over time.

According to an advantageous embodiment, the maximum depth of the recess 33 can be between 25% and 300%, in particular between 50% and 150%, of the distance between the dispensing aperture 12 of the distal wall 21*a* when the needle 21 is in the opening position, i.e. the depth of the swirl chamber 11. In the embodiment shown, the depth of the supply channels 13 is constant and equivalent to that of the swirl chamber 11.

Thus, the depth of the recess 33 is sufficient to ensure the non-convexity of the base of the swirl chamber 11, while being limited enough not to notably affect the properties of the aerosol dispensed, in particular not being so great as to form a counter-swirl chamber. Thus, the quality of the aerosol remains identical from one production to another while maintaining high production and assembly rates. Alternatively, the depth of the recess can be increased so as to form a counter-swirl chamber.

In the embodiment shown, the distal wall 21*a* is planar and the recess 33 is formed in the central portion of said wall, in particular by being centered on the axis of the dispensing aperture 12. Thus, the vortex formed in the swirl chamber 11 is stable since it is based on a virtually planar and reproducible wall 21*a* due to the presence of the recess 33.

In addition, the recess 33 has a rotary shape, more specifically a rotary cylindrical shape in the embodiment shown. Alternatively, a slightly frustoconical or semi-elliptical shape can be provided. According to one embodiment, the recess 33 can have an opening of which the dimension is between 20% and 80% of the diameter of the swirl chamber 11.

In an example embodiment, the diameter of the dispensing aperture 12 is 0.25 mm, the diameter of the swirl chamber 11 is 1.6 mm, the diameter of the distal wall 21*a* of the needle 21 is 1.5 mm, the depth of the supply channels 13 and the swirl chamber 11 is between 0.2 and 0.5 mm, the diameter of the recess 33 is at least 0.45 mm and the depth thereof is at least 0.1 mm.

What is claimed is:

1. A push-button for a pressurized product dispensing system, in which said push-button includes a body having a mounting shaft on a pressurized product supply tube and a housing in communication with said shaft, in which said housing is equipped with a passage for dispensing the product between said shaft and a swirl assembly including a swirl chamber provided with a dispensing aperture as well as at least one supply channel for said chamber, in which said push-button also includes a needle movably mounted in the housing between a position closing the supply of the dispensing aperture and a position opening said supply; said needle has an actuation bearing in communication with the dispensing passage so as to enable the movement of said needle in the opening position by pressurization of the product in said passage; said push-button is characterized in that the needle has a distal wall arranged opposite the dispensing aperture so as to form the base of the swirl chamber when said needle is in the opening position, and said distal wall has a recess, and wherein the needle is mounted in translation with respect to the dispensing aperture between the closure position in which the distal wall is pressed tightly against said aperture so as to close off the supply thereof and the opening position in which said distal wall is removed from said aperture to form the base of the swirl chamber.

2. The push-button according to claim 1, wherein the maximum depth of the recess is between 25% and 300% of the distance between the dispensing aperture and the distal wall when the needle is in the opening position.

3. The push-button according to claim 1, wherein the distal wall of the needle is planar, and the recess is formed in the central portion of said wall.

4. The push-button according to claim 1, wherein the recess is centered on the axis of the dispensing aperture.

5. The push-button according to claim 1, wherein the recess has a rotary shape.

6. The push-button according to claim 1, wherein the swirl chamber is formed between a dispensing assembly cavity and a distal end of the needle on which the distal wall is formed, in which said end is arranged in said cavity when the needle is in the closure position.

7. The push-button according to claim 1, further comprising means for resiliently returning the needle to the closure position.

8. The push-button according to claim 1, wherein the rear of the dispensing passage is defined by the actuation wall.

9. The push-button according claim 1, further comprising a barrel secured to the housing, in which the needle is movably mounted in a bore of said barrel, and the dispensing passage is formed between the periphery of said barrel and the inside of said housing.

10. The push-button according to claim 9, wherein the barrel as a rear portion in which the actuation bearing of the needle is housed, and said rear portion communicates with the dispensing passage by means of at least one passage formed in said barrel.

11. The push-button according to claim 10, wherein the actuation bearing is mounted so as to slide tightly into the rear portion, in which the front of said bearing is in communication with the dispensing passage and the rear of said bearing is in communication with a venting conduit formed in the bodyof the push-button.

12. The push-button according to claim 9, wherein the barrel has a distal wall that is in contact with the supply channels of the swirl chamber so as to define the base thereof.

13. The push-button according to claim 1, further comprising a spray nozzle arranged in the recess, in which said nozzle has a front radial wall on the inside of which a cavity for the supply channels as well as the swirl chamber equipped with the dispensing aperture are formed.

14. A system for dispensing a pressurized product, including a discharge device equipped with a pressurized product supply tube on which the shaft of a push-button according to claim 1 is mounted so as to enable the product to be sprayed.

* * * * *